US009560889B1

(12) United States Patent
White

(10) Patent No.: US 9,560,889 B1
(45) Date of Patent: Feb. 7, 2017

(54) SWIMWEAR VEIL

(71) Applicant: Kandice Kay White, Plano, TX (US)

(72) Inventor: Kandice Kay White, Plano, TX (US)

( * ) Notice: Subject to any disclaimer, the term of this patent is extended or adjusted under 35 U.S.C. 154(b) by 0 days.

(21) Appl. No.: 14/877,068

(22) Filed: Oct. 7, 2015

Related U.S. Application Data

(60) Provisional application No. 62/060,649, filed on Oct. 7, 2014.

(51) Int. Cl.
*A41D 27/08* (2006.01)
*A41D 7/00* (2006.01)

(52) U.S. Cl.
CPC ..... *A41D 27/08* (2013.01); *A41D 7/001* (2013.01)

(58) Field of Classification Search
CPC ..... A41D 27/08; A41D 7/00; A41D 7/001; A41B 2400/00; A41B 2300/00
USPC ..... 2/244, 67, 75, 80, 105, 110, 111, 210,2/217, 227, 243.1
See application file for complete search history.

(56) References Cited

U.S. PATENT DOCUMENTS 3,602,919 A * 9/1971 Piccione ..... A42B 5/00 2/207
4,815,145 A * 3/1989 Chow ..... A41D 7/00 2/67
5,561,858 A * 10/1996 Poirier ..... A41D 7/00 2/408
2007/0157367 A1* 7/2007 Kerkhoff ..... A41D 1/14 2/227
2007/0271683 A1* 11/2007 McCrary ..... A41D 15/002 2/244
2010/0293700 A1* 11/2010 Gillespie ..... A41D 15/002 2/244
2015/0071978 A1* 3/2015 Chang ..... A61N 2/06 424/402
2015/0173427 A1* 6/2015 Sawyer ..... A41D 7/00 2/67

* cited by examiner

*Primary Examiner* — Katherine Moran
(74) *Attorney, Agent, or Firm* — Richard G. Eldredge

(57) ABSTRACT

A veil for a swimsuit bottom includes a body composed of a fabric material and configured to cover a portion of a bottom of the swimsuit; and a fastener secured to a top of the body and configured to engage with a top edge of the bottom of the swimsuit. The fastener being configured to removably secure the body to the bottom.

3 Claims, 4 Drawing Sheets

SWIMWEAR VEIL

BACKGROUND

1. Field of the Invention

The present invention relates generally to a veil, and more particularly, to a veil configured to removably secure to a bottom portion of a two-piece swimsuit.

2. Description of Related Art

Two-piece swimsuits, such as a bikini, tankini, and the like, are well known in the art and are common articles of clothing among women during, for example, swimming activities, sun bathing, and/or social events.

FIG. 1 depicts a back view of a conventional two-piece swimsuit 101 comprising a top portion 103 and a bottom portion 105. In the exemplary embodiment, the bottom portion 105 (hereinafter referred to as a "bottom") is configured to cover the majority of the user's waist and buttocks. However, it should be understood that the swimwear bottom 105 is manufactured in various shapes and sizes. A common feature with conventional swimwear bottoms 105 is that the edge 107 that wraps around the periphery of the woman's waist.

It should be understood that in some scenarios, the user becomes insecure with the amount of skin exposure when wearing the two-piece swimsuit. For example, in social events, the user may feel that the exposure is inappropriate. Although great strides have been made in the area of swimwear, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
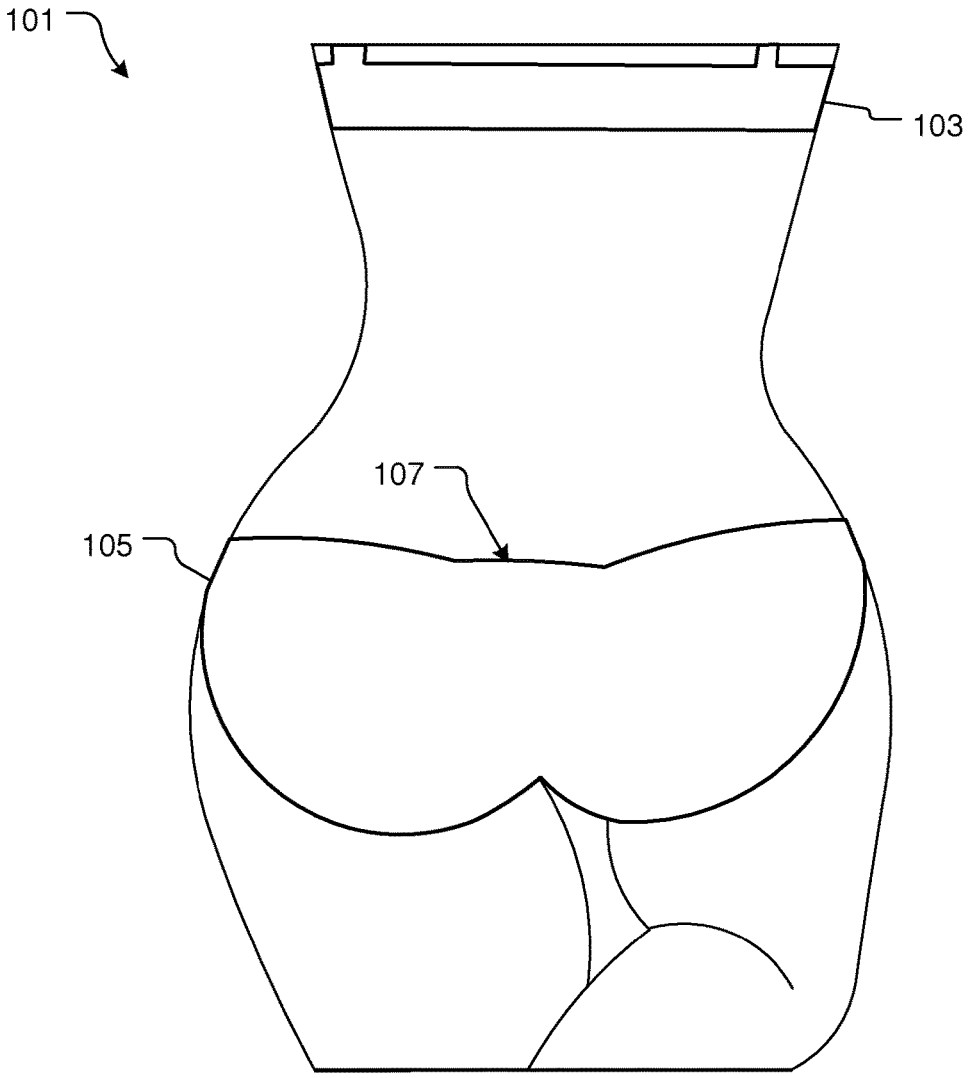
FIG. 1 (Prior Art)
FIG. 1 is a back view of a conventional two-piece swimsuit.

While the swimsuit veil and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the swimsuit veil and method of use of the present application are provided below. It will of course be appreciated that in the development of any actual embodiment, numerous implementation-specific decisions will be made to achieve the developer's specific goals, such as compliance with swimsuit veil-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The swimsuit veil and method of use in accordance with the present application overcomes one or more of the above-discussed problems commonly associated with conventional swimsuits. Specifically, the present application includes the unique features of a swimsuit veil configured to cover the exposed areas of a portion of the waist, buttocks, and/or thigh. In addition, the veil is configured to provide an aesthetically pleasing appearance for special events, for example, a bride's party, wherein the bride is adorned with the veil as a gift from friends. These and other unique features of the swimsuit veil and method of use are discussed below and illustrated in the accompanying drawings.

The swimsuit veil and method of use will be understood, both as to its structure and operation, from the accompanying drawings, taken in conjunction with the accompanying description. Several embodiments of the swimsuit veil are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2:
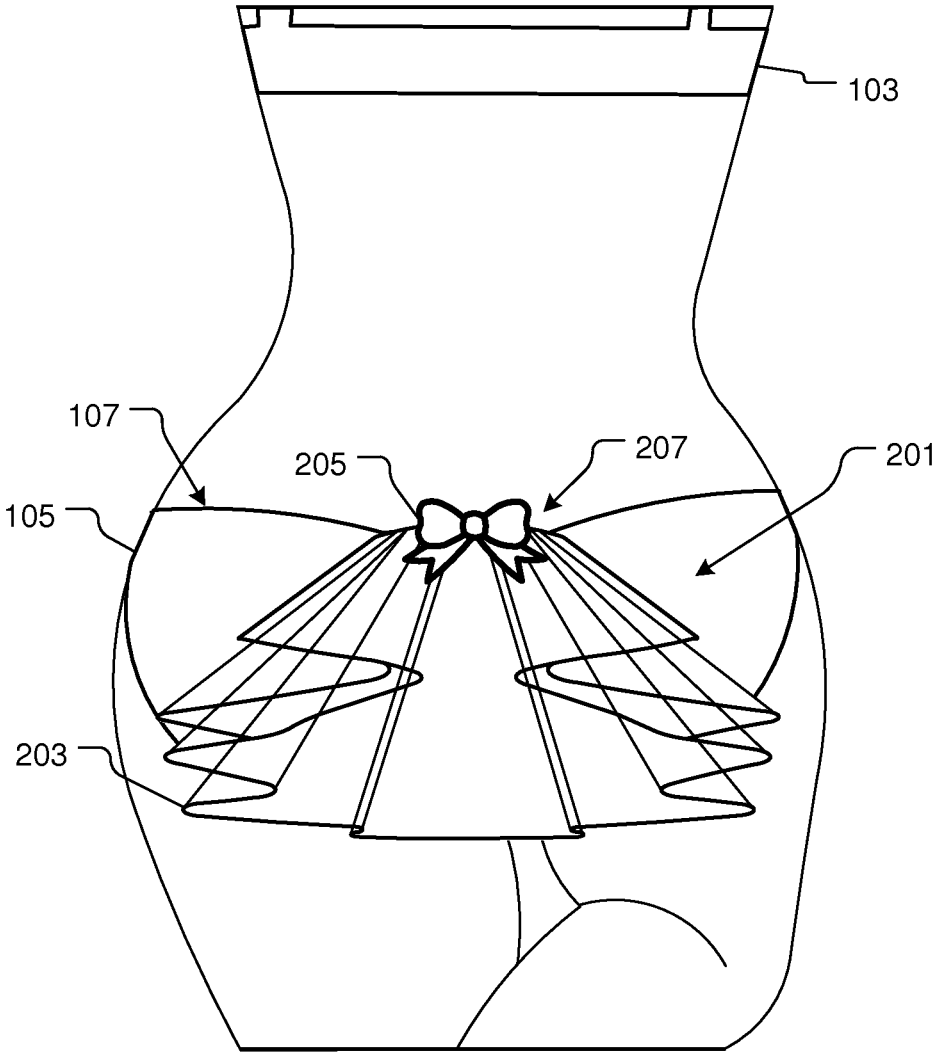
FIG. 2 is a front view of a swimsuit veil in accordance with a preferred embodiment of the present application.

Referring now to the drawings wherein like reference characters identify corresponding or similar elements throughout the several views, FIG. 2 depicts a simplified front view of a swimsuit veil 201 in accordance with a preferred embodiment of the present application. It will be appreciated that the swimsuit veil 201 overcomes one of more of the above-listed problems commonly associated with the conventional two-piece swimsuits. Specifically, the veil 201 is configured to cover exposed areas in addition to providing aesthetically pleasing appearances.

In the contemplated embodiment, swimsuit veil 201 includes one or more of a body of fabric 203, a decorative ornament 205, and a fastener 207. In the exemplary embodiment, body 203 is preferably composed of a tulle fabric material, which in turn provides notice of a bride to other third parties. Thus, veil 201 could be given as a gift to the bride from friends and/or family members. In an alternative embodiment, the fabric material could be composed of a different type of material. For example, it is contemplated having an embodiment that includes washable material that could be used during swimming activities and/or washed in the washing machine. Further, the body 203 could be manufactured in various shapes and designs, for example, a wider length to cover additional exposed body areas.

Although shown attached to the back side of bottom 105, it should be appreciated that alternative embodiments could include a body 203 that peripherally extends around the entire waist of the user.

Ornament 205 is an optional feature and provides additional aesthetic appearance. In the exemplary embodiment, ornament 205 is a bow; however, other ornaments such as jewelry, ribbons, and the like could be used in lieu of the contemplated embodiment.

One of the unique features believed characteristic of the present application is the use of a fastener 207 securely attached to body 203 about a top portion and configured to removably attach the body 203 to bottom 105. In the preferred embodiment, fastener 207 secures to the edge 107 of the bottom 105, as is further shown in FIGS. 3-5 and discussed below. It will be appreciated that fastener 207 could be configured to attach to a strap, belt, and/or other items of clothing worn by the user. For example, the user may wish to wear veil 201 with shorts or pants in lieu of the contemplated swimwear bottom 105. The features discussed herein could be incorporated with such items of clothing.

Figure 3:
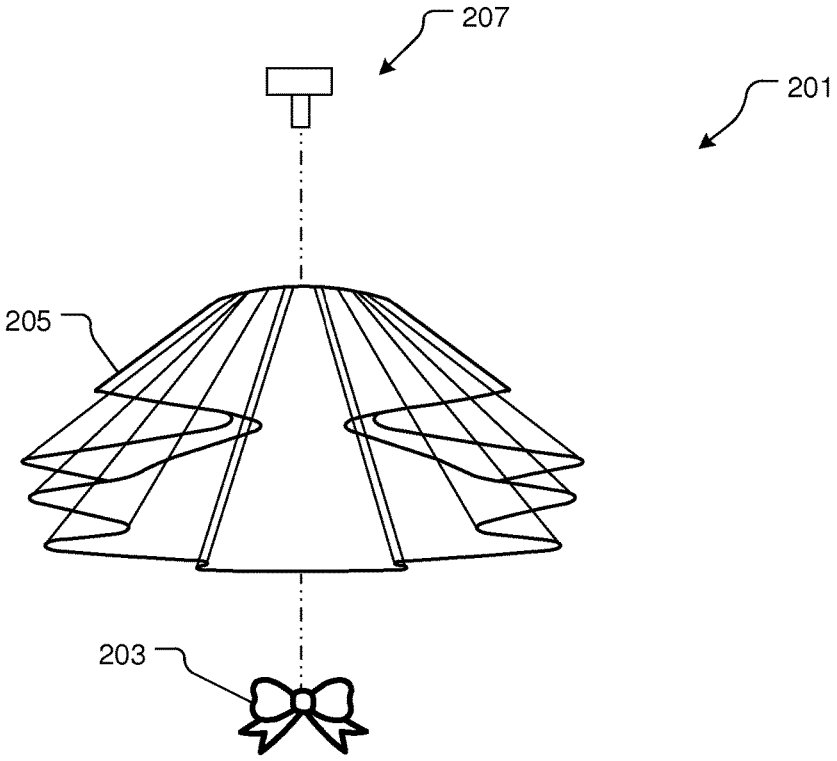
FIG. 3 is an exploded front view of the swimsuit veil of FIG. 2.
Figure 4:
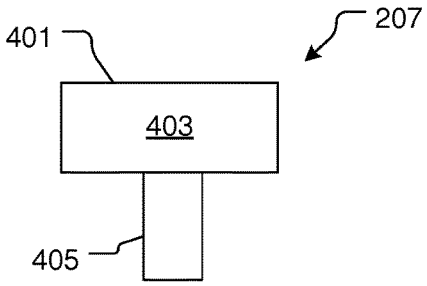
FIG. 4 is a front view of a fastener of the swimsuit veil of FIG. 2.
Figure 5:
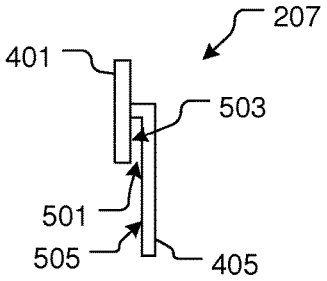
FIG. 5 is a side view of the fastener of FIG. 4.

In FIG. 3, a disassembled view of veil 201 is shown. In FIGS. 4 and 5, respective enlarged front and side views of the fastener 207 are shown. Fastener 207 preferably includes one or more of a base 401 having a front surface 403 that comes into contact with body 203. An elongated member 405 is rigidly attached to and extends from a back surface 503 of base 401. A gap 501 is formed by back surface 503 of base 401 and a front surface 505 of elongated member 405. Thus, in the contemplated embodiment, the gap 501 is used to receive the edge 107 of bottom 105 in a clip-like fashion. This embodiment could also be modified to include a simplified clip design, all falling within the scope of the contemplated embodiment.

Figure 6:
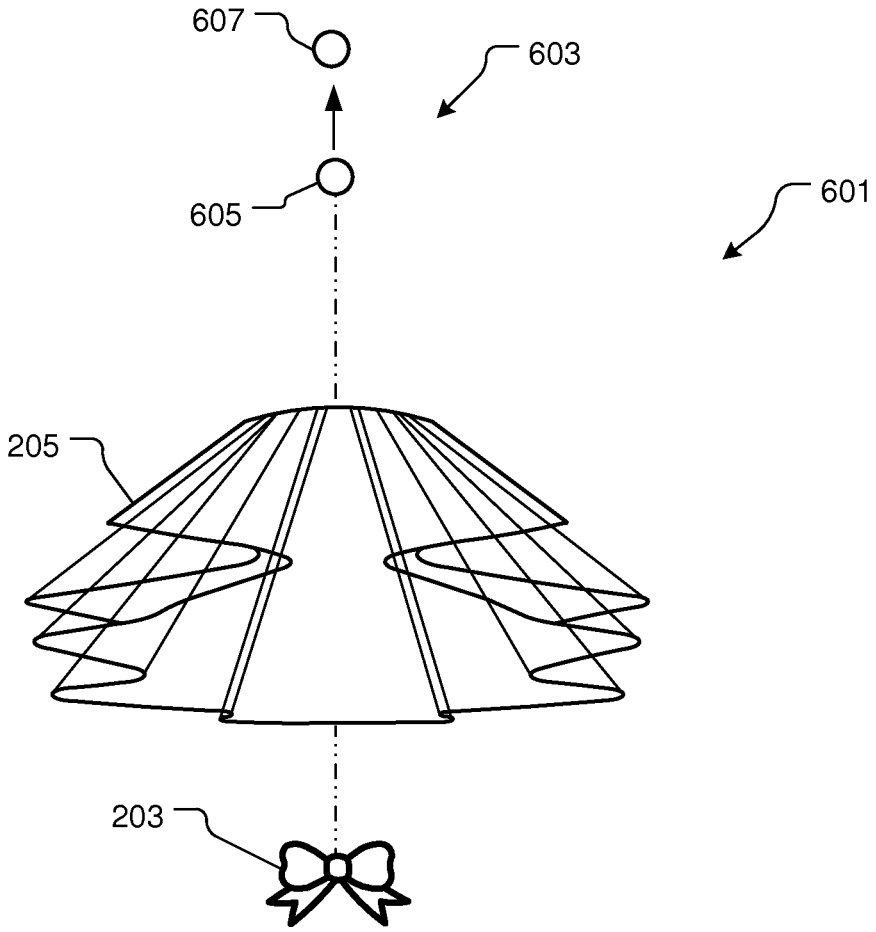
FIG. 6 is a front view of a swimsuit veil in accordance with an alternative embodiment of the present application.

Fastener 207 uses a clip configuration to secure the veil to the edge 107 of bottom 105; however, it will be appreciated that alternative embodiments of fastener 207 are also contemplated. For example, FIG. 6 depicts another embodiment of veil 201 substantially similar in form and function, except veil 601 utilizes a fastener 603 comprising two components that removably engage with each other; the first component 605 being configured to securely attach to the body 205 of the veil 601 and a second component 607 that secures to the bottom 105 of the swimsuit 101. In one contemplated embodiment, component 605 is a button or other quick release device that snaps in a locked position with component 607 rigidly attached to bottom 605. Other embodiments are also contemplated, for example, the components 605, 607 could be magnets that engage with each other. These and other fasteners can be used to removably attach one or more different types of interchangeable veils to the bottom of the swimsuit.

It will be appreciated that in an alternative embodiment, the features of the fastener could be a safety pin that secures directly to the body of the veil and removably secures to the article of clothing attached thereto.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A combination swimsuit bottom and veil, comprising:

the swimsuit bottom having:

a body of fabric material; and a top edge extending around the body of the fabric material; and the veil having:

a veil body composed of a tulle fabric material and configured to cover a portion of the swimsuit bottom; and a fastener rigidly secured to a top section of the veil body and configured to removably engage with the top edge of the swimsuit bottom, the fastener having:

a base rigidly secured to the top section of the veil body; and an elongated member rigidly attached to a rear surface of the base and extending parallel relative to the base;

wherein the rear surface of the base and the elongated member form a gap;

wherein the gap is configured to slidingly engage with the top edge of the swimsuit bottom; and wherein the veil body is configured to cover solely a portion of a back surface of the swimsuit bottom.

2. The combination swimsuit bottom and veil of claim 1, wherein the fabric material is washable.

3. The combination swimsuit bottom and veil of claim 1, further comprising:

a removable ornamental object secured to the veil body.

* * * * *